United States Patent [19]

Salomon

[11] 3,970,326

[45] July 20, 1976

[54] SAFETY SKI BINDING DEVICE

[75] Inventor: Georges Pierre Joseph Salomon, Annecy, France

[73] Assignee: S.A. Etablissements Francois Salomon & Fils, Annecy, France

[22] Filed: Jan. 15, 1975

[21] Appl. No.: 541,131

[30] Foreign Application Priority Data

Jan. 28, 1974 France ..... 74.2766

[52] U.S. Cl. ..... 280/626

[51] Int. Cl.[2] ..... A63C 9/08

[58] Field of Search ..... 280/11.35 T

[56] References Cited

UNITED STATES PATENTS

| | | | |
|---|---|---|---|
| 3,249,365 | 5/1966 | Beyl | 280/11.35 T |
| 3,466,057 | 9/1969 | Dobler | 280/11.35 T |
| 3,612,560 | 10/1971 | Payrhammer | 280/11.35 T |
| 3,797,843 | 3/1974 | Salomon | 280/11.35 T |

*Primary Examiner*—Robert R. Song

[57] ABSTRACT

The safety binding for a ski boot comprises a retaining element for one end of the boot mounted to pivot about links hinged in relation to the ski; a first system of locks consisting of a system of ramps and stops, and a second lock consisting of a second system of ramps and stops which temporarily prevent the retaining element from pivoting, forcing it to move against the action of a resilient element. The second system of locks prevents the binding from releasing itself as a result of an inadvertent impact.

16 Claims, 9 Drawing Figures

SAFETY SKI BINDING DEVICE

This invention relates to a saftey binding for a ski boot; it relates, more particularly, to bindings comprising a retaining element for one of the boot, the element being mounted to pivot about links hinged in relation to the ski.

Bindings of this kind are already known. Canadian Patent No. 495,501 issued Aug. 25, 1953 to Yovanovitch, for instance, describes a heel member designed to hold the rear end of the boot. This heel member consists of two lateral arms (or links), one on each side of the ski, the arms being hinged at one end, in relation to the ski, and pivoting about a first axis parallel with the plane of the ski. The retaining element is free to rotate and displace itself about a second axis parallel with the plane of the ski uniting the other end of the lateral arms. This retaining element comprises a jaw for holding the boot and is applied to the sole of the boot by a resilient element.

Yovanovitch proposes two variants of this arrangement; both of these will be described in conjunction with FIGS. 1, 1*a*, 1*b* and 2, 2*a* which indicate the operating principle of these bindings.

FIGS. 1, 1*a*, 1*b* illustrate diagrammatically the binding shown in FIG. 1 of the above-mentioned Yovanovitch patent.

Reference numerals 61*a*, 68*a*, 60*a*, 76*a*, 64*a* indicate respectively links 61*a*, axis 68*a* upon which the links are hinged in relation to the ski, a second axis 68*a* parallel with the plane of the ski joining the other end of the links, jaw 76*a* holding the end of the boot, and resilient element 64*a*, the references of which in the Yovanovitch patent are respectively 61, 68, 60, 76, 64.

In the case of this Yovanovitch variant, it will be observed that the plane defined by axes 68*a*–60*a* is ahead of (and above) the contact between the boot and jaw 76*a*. Yovanovitch designates this arrangement conventionally by the sign ( − ). This variant operates as follows.

Under the action of a vertical load, the boot lifts and compresses resilient element 64*a*. During this movement, planes 68*a*–60*a* and 68*a*–76*a* pivot together forwardly in the direction of arrow $F_1$. It is not proposed to deal here in detail with the way in which, in this variant of the Yovanovitch invention, the end of the boot (or a piece applied to the heel of the boot) pushes links 61*a* backwards, in the direction of arrow $F_2$, when the vertical load, acting against the resilient element, reaches a limiting value which is acceptable for the skier's safety. But it is clear that as soon as dead centre has been passed (i.e. as soon as the area of contact between the boot and jaw 76*a* reaches plane 68*a*–60*a*, as shown in FIG. 1*a*, and then passes it, as shown in FIG. 1*b*), resilient element 64*a* assists in actuating the links in the direction of arrow $F_2$, FIG. 1*b*, and in releasing the boot from the heel member.

This first variant of the Yovanovitch binding has several disadvantages.

In the first place, it will be observed that a light impact in the direction of arrow $F_2$, at the end of the links (at 60*a*, for example), will suffice to cause the links to pivot into the position of release shown in FIG. 1*a*. This light impact might be applied by the skier's poles, by lack of skill, or by the other ski; this would cause inadvertent release of the binding, regardless of whether the skier be experienced or a beginner. There is no need for this impact to be very heavy since, on the one hand, the links constitute a lever arm which amplifies any load at the ends thereof while, on the other hand, the angle between planes 68*a*–76*a* and 68*a*–60*a* is preferably small, for many reasons which will not be gone into here (mechanical performance, space, etc.). As a result of this, inadvertent releases are frequent, since a light impact is enough to tilt the heel member to the rear into the release position.

In a design of this kind, the binding as a whole always tends to rotate in the direction of arrow $F_1$, and it therefore has to be stabilized. According to Yovanovitch, stabilization is achieved by causing the links to rest upon a part integral with the sole of the boot, the location of which may vary from one boot to another, or from one assembler to another, if assembly was not carried out in the plant. In other bindings of this type, the member carrying the jaw bears against the back of the boot upper, and this is not standardized; the result of this is that in spite of a system of adjustment, the location of the member is a function of the shape of the boot upper, and the release load and resilient travel may vary in a random manner, quite incompatible with safety.

It is the purpose of this present invention to overcome these disadvantages and also those of the second Yovanovitch variant, which will now be described in conjunction with FIGS. 2, 2*a*.

FIGS. 2, 2*a* illustrate diagrammatically the heel member shown in FIGS. 24, 25, 26 of the aforesaid Youanovitch patent.

Reference numerals 83*a*, 68*a*, 60*a*, 81*a*, 64*a* indicate respectively links 83*a*, axis 68*a* upon which the links are hinged in relation to the ski, a second axis 60*a* parallel with the plane of the ski joining the other end of the said links, jaw 81*a* holding the end of the boot, and resilient element 64*a*, the references of which in the Yovanovitch patent are respectively 63, 68, 60, 80 and 64.

In this second Yovanovitch variant, it will be observed that plane 68*a*–60*a* is at the back and below the contact between the boot and the jaw; Yovanovitch designates the arrangement conventionally by the sign ( + ).

In the event of an accidental safety release, this variant operates as follows.

Under the action of a vertical load, the boot lifts. During this movement, the boot tends, by means of resilient element 64*a*, to push plane 68*a*–60*a* rearwardly in the direction of arrow $G_1$. In order to prevent this movement, a stop is provided, the stop being integral with the jaw (to be more precise, the stop is integral with the retaining element comprising jaw 81*a* and containing resilient element 64*a*). The stop bears against links 83*a* and prevents them from tilting rearwardly. Thus jaw 81*a*, pushed back by the boot, lifts against the action of the resilient element.

It is not proposed to describe here in detail how the stop escapes from the links when the vertical load, opposing the action of the resilient element, reaches the limiting value acceptable for the skier's safety. It is clear, however, that as soon as the links are released they will tilt rearwardly, impelled, on the one hand, by the action of the boot and, on the other hand, by resilient element 64*a* which has just been compressed and which expands.

This second variant of the Yovanovitch binding also has several disadvantages.

It will be observed that a light impact in the direction of arrow $G_2$ (FIG. 2*a*), at the end of links 60*a*, for example, would cause the heel member to pivot into a position such that plane 68*a*–60*a* will be located ahead of and above the area of contact between jaw 81*a* and the boot (FIG. 2*a*). It should be noted that this location of the heel member is identical with that described above in connection with FIGS. 1, 1*a*, 1*b*. In this case, however, the heel member will be locked irreversibly, since it has no means of pushing links 83*a* rearwardly, in the direction of arrow $G_3$. In this variant, therefore, an inadvertent blow from the ski poles, or the other ski, on the heel member results in the heel member being locked irreversibly.

In order to overcome these disadvantages, which are prejudicial to the skier's safety, it is usual for the body of the retaining element to bear against the boot upper. This, however, has the disadvantage mentioned above, namely that boots vary quite considerably in shape, at least enough to provoke random release of the heel member.

It is the purpose of this present invention to overcome all of these disadvantages.

This present invention covers a system such that, on the one hand, the relative movement of the retaining element in relation to the links is substantially the same at all times, and is therefore independent of the shape of the boot and, on the other hand, an inadvertent and even heavy impact at end 60*a* of the retaining element will have no effect, i.e. it will neither unlock the heel member nor jam it.

According to a first characteristic of the invention, the binding comprises a first system of locks consisting, more particularly, of a system of ramps and stops temporarily interposed between two of the three following elements which are in relative motion, namely the boot, the links, and the retaining element, in a manner such that, at the time of the release, the elements in relative motion can move temporarily only against the action of the resilient element in an axis system connected to the links, the path of travel of the point where the jaw rests upon the end of the boot being substantially the same at all times in the event of an accidental release resulting from a vertical load.

According to a second characteristic of the invention, the binding comprises a second lock consisting, more particularly, of a system of ramps and stops temporarily interposed between two of the three following elements in relative motion, namely the boot, the links, and the retaining element, in a manner such that the retaining element cannot pivot temporarily in relation to the boot or the links, especially as a result of an inadvertent impact upon the end of the retaining element.

In certain variants according to the invention, the ramp in the first system of locks is integral with the retaining element, while the stop in the first system of locks is integral with the links. For the purposes of these variants, and according to an additional characteristic of the invention, the ramp in the second system of locks is also integral with the retaining element, while the stop in the second system of locks is also integral with the links.

In certain variants, the retaining element is mobile in rotation and displacement in relation to the second axis uniting the rear end of the links which slides in a slot integral with the retaining element.

In these variants, the ramp in the second system of locks is preferably located opposite the ramp in the first system of locks, while the stops in the first and second systems of locks consist of a cross member integral with the links, so that, generally speaking, in the event of a release, or when the retaining element moves in relation to the links, the cross member slides between the two ramps. The result of this is that in a reference system involving the links, the path of travel of the point of support of the jaw is the same at all times, regardless of the shape of the boot. Moreover it is obvious that the outline of the ramps may always be selected to ensure that, on the one hand, the retaining element moves against the action of the resilient element in the event of an accidental release and, on the other hand:

if the point of support of the jaw upon the end of the boot is located above the plane defined by the first and second hinge axes of the links, the path of travel of this point of support will never intersect this plane;

if the point of support of the jaw is located above the plane defined by the first and second axes, the path of travel of this point of support intersects the said plane. This will be seen in the detailed description of some of the variants of the invention.

In the case of the variant just described, it is also possible, according to another characteristic of the invention, to provide, on the retaining element, a third ramp extending the first or second ramp. A stop comes to rest against this ramp, the stop being integral with the links and consisting of the cross member. This third ramp makes it possible to guide the movement of the retaining element around the second axis, after the resilient element has been compressed. Moreover, if this third ramp is substantially circular, as is preferable, and is centered upon the second axis when the retaining element is in the so-called release position, the latter will be in neutral equilibrium, although the resilient element is kept tensioned. As will be seen hereinafter, this makes it easy for the skier to replace his skis. It is also possible to provide a voluntary release lever pivoting about the second axis uniting the links; this lever comprises a lug bearing against a ramp integral with the releasing element. By actuating this lever, the skier first of all causes the releasing element to slide, in relation to the second axis, against the action of the resilient element, after which it causes it to pivot, thus making it easy for the skier to release his boot.

In other variants also comprising a retaining element mobile in rotation and displacement in relation to the second axis, on the one hand the ramps and stops in the first system of locks are respectively integral with the boot upper and with the end of the lever hinged to the links and, on the other hand, the ramps and stops in the second system of locks are respectively integral with the boot and the end of the lever which pivots in relation to the links.

In these variants, the ramps for the first and second locks are preferably located opposite the back of the boot upper; the stops for the first and second locks consist preferably of a cross member parallel with the plane of the ski located at the end of the lever, so that, when a release occurs, the cross member slides between the two ramps, thus guiding the movement of the releasing element in relation to the links.

In addition to this, in these variants, the lever may comprise an operating element by means of which the skier may voluntarily release the cross member from the two-ramp system and pivot the links downwardly, thus enabling him to withdraw the boot freely from the heel member.

In other variants, the releasing element consists of a plurality of elements hinged in relation to each other and in relation to the links. In the case of these variants, the first and second locks may be interposed between any two of the parts in relative motion, preferably between one of the members constituting the retaining element and the links, or between one of the members constituting the retaining element and the boot. This applies especially when the retaining element consists of:

a member which is mobile in rotation about the second axis;

a jaw hinged about an axis integral with the member;

a resilient element resting, on the one hand, upon the member and, on the other hand, on the jaw.

In this variant, the ramp and stop of the first system of locks are respectively integral with the boot and the member, and the same applies to the ramp and stop of the second system of locks.

Moreover, the ramps of the first and second systems of locks are located opposite each other on the end of the boot; the stops of the first and second systems of locks consist of a cross member parallel with the plane of the ski. According to another characteristic of the invention, in this particular variant, one of the ramps integral with the boot, more particularly the ramp of the second lock, is mounted on a pawl which can be retracted by means of an element which may be operated by the skier whenever he wishes to remove his skis.

A detailed description will now be given of a few variants, given as non-restricting examples, in conjunction with the drawings, wherein.

Figure 3:
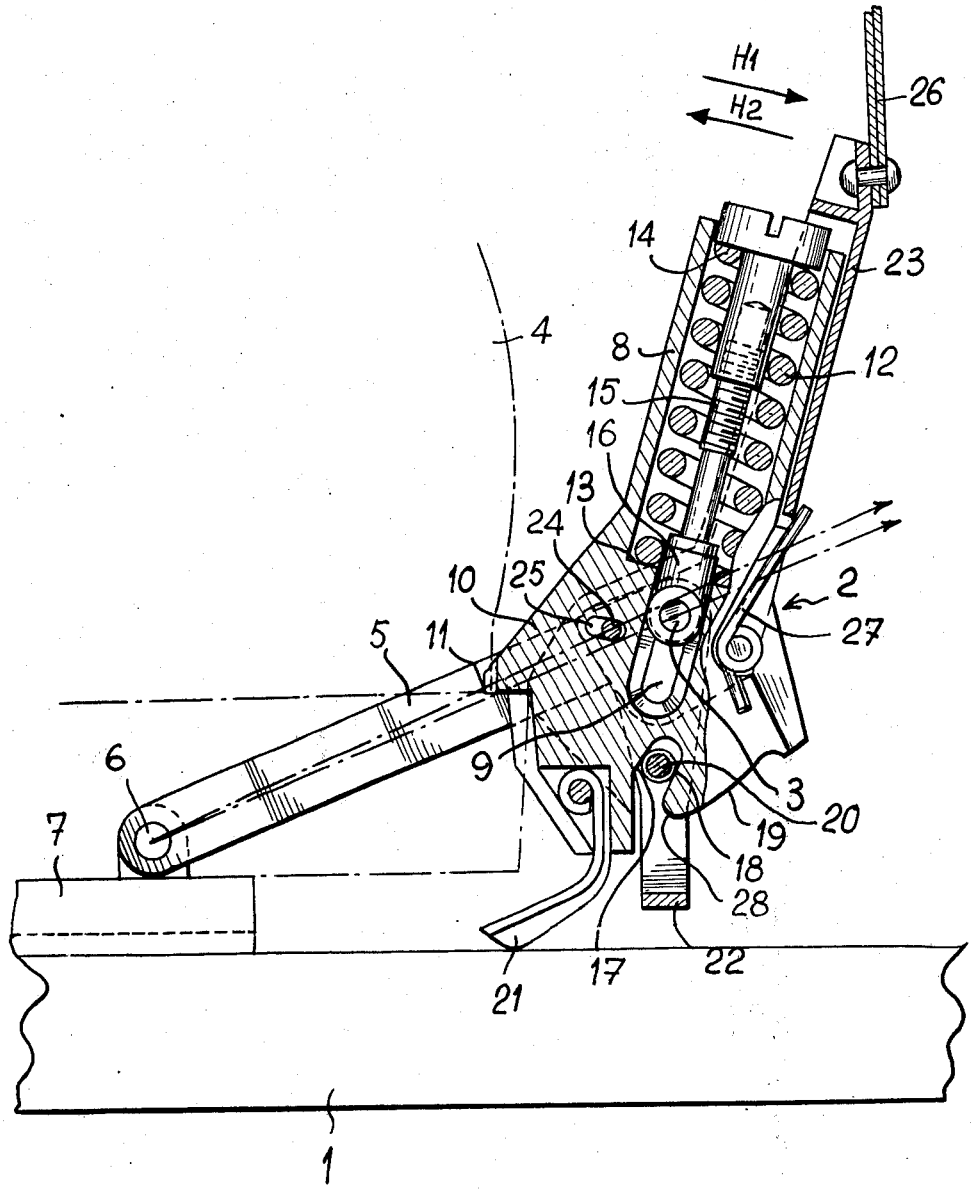
FIG. 3 is a longitudinal section through a first variant of the binding according to the invention.

FIG. 3 is a longitudinal section through a first variant of the binding according to the invention, with the boot in position. Heel member 2, which will be described in detail hereinafter, is mobile in rotation about an axis 3 which connects, behind the skier's heel 4, the ends of the two lateral arms 5 (or links) running along each side of the boot. These links are mobile in rotation about an axis 6 parallel with the plane of the ski and with axis 3 which is integral with a baseplate 7 located under the skier's heel. This baseplate may either be attached directly to the ski (by means of screws, not shown, for example) or be mounted to rotate about a vertical pivot which is itself attached to ski 1. Heel member 2 consists mainly of a hollow body 8 equipped with a slot 9 in which axis 3 slides. This body comprises a retaining jaw 10 for the boot resting, at 11, upon the edge of the sole of the boot. Located within the hollow body is a resilient element 12, more particularly a coil spring, one end of which rests against a shoulder 13 located within the body, while the other end bears against a collar 14 screwed adjustably to the end of a threaded rod 15. The other end of this rod is screwed into a sleeve adapted to rotate about an axis 3 integral with links 5.

It will be observed that in this variant, the direction of the axis uniting first axis 6 to point of support 11 of the jaw on the boot is located above the plane uniting the first axis 6 to the second axis 3.

Located in the lower portion of the body is a system of three ramps 17, 18, 19; two of them, 17 and 18, are substantially parallel with and opposite each other. A cross member 20, uniting links 5, slides in the inverted U-shaped slot formed by the two ramps 17, 18. The third ramp 19 is an extension of ramp 18; it is substantially circular and the location of its centre will be defined hereinafter.

The heel member also comprises a pedal 21 which is hinged to the lower end of the body and facilitates the attachment of this binding to the boot. The links are extended downwardly by a part 22 which rests upon the ski in the absence of the boot.

The heel member furthermore comprises a manual ski-removal lever 23 hinged to the second axis uniting the links. One end of this lever carries a pin 24 sliding in a slot 25 in the body. The skier may actuate this lever, for voluntarily removing his ski, by means of an actuating element 26 such as a thong, or with the tip of his ski-pole. A return spring 27 holds the lever against the body of the heel member. The operation of this binding will now be described.

In the event of an accidental release brought about by an abnormally high vertical load, boot 4 lifts and pushes jaw 10 and body 8, which tends to pivot backwards, rearwardly in the direction of arrow $H_1$ and about axis 3 which unites the links. Rotation of the body is impossible because the profile of first ramp 18, substantially parallel with the axis uniting the second axis 3 and cross member 20, opposes the pivoting of the body; the latter is thus forced to rise with the boot against the action of coil spring 12, the longitudinal axis of which is substantially parallel with that of first ramp 18; during this movement, the second axis 3 slides in slot 9 in the body. The cross member slides along first ramp 18; when it passes the release nose 28, the body pivots rearwardly. Cross member 20 then bears against circular third ramp 19, the centre of which is arranged, by construction, in a manner such that it coincides substantially with the second axis 3 in the position it occupies at the moment of release. Backward rotation of the body therefore produces no change in the tension of the spring, and the latter remains compressed; in this inoperative position of the body, the heel member is in neutral equilibrium.

In the event of an inadvertent impact in the direction of arrow $H_2$, none of the elements constituting the binding moves, since second ramp 17, integral with the body, is stopped by cross member 20 and prevents the body from pivoting forwardly. The result of this is that the point of support 11 of the jaw on the sole of the boot cannot descend below the plane defined by the first and second axes of rotation 3 and 6 located at the ends of the links.

In order to remove the skis voluntarily, the skier actuates ski-removal lever 23 backwardly in the direction of arrow $H_1$, which raises the body in displacement; during this movement, cross member 20 slides between ramps 17 and 18; as soon as it passes release nose 28, body 8 pivots rearwardly and releases the boot.

Figure 4:
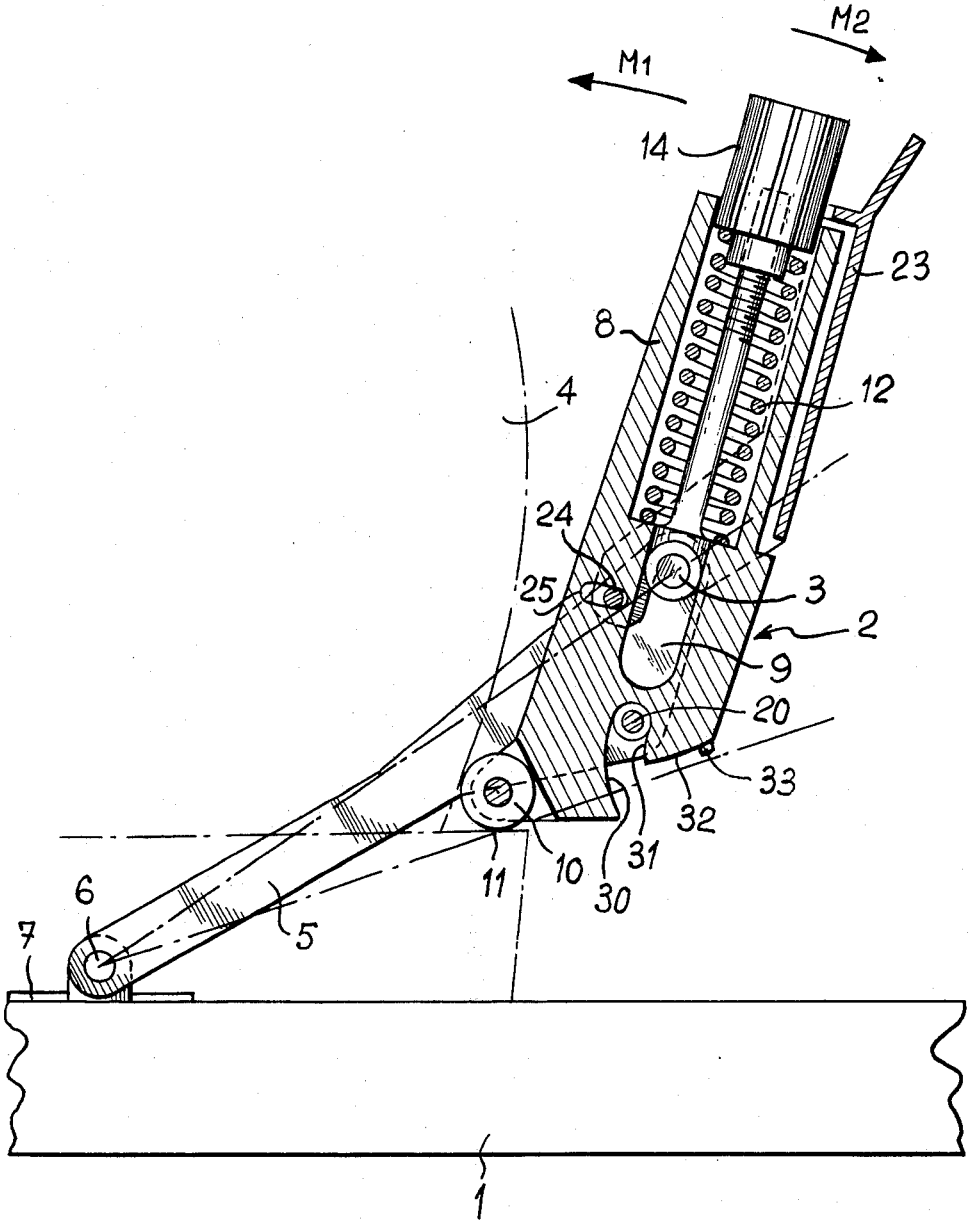
FIG. 4 is a longitudinal section through a second variant of the binding according to the invention.

A description will now be given of FIG. 4 which is a longitudinal section through a second variant of the binding according to the invention, with the boot in position.

Most of the elements described in conjunction with FIG. 3 will be recognized, especially ski 1, boot heel 4, heel member 2 which is mobile in rotation and displacement in relation to the second axis 3 uniting links 5, the links hinged about the first axis 6, spring 12, and ski-removal lever 23.

In this variant, the plane defined by the first and second hinge axes 6 and 3 of the heel member, and the links, is located above point of support 11 of jaw 10 on the sole of the boot.

In this particular variant, the lower part of the body comprises a system of three ramps 30, 31, 32. First ramp 30 and second ramp 31 are located opposite, and substantially parallel with, each other. It is emphasized that the first and second ramps occupy positions which are the reverse of those described in connection with FIG. 3. It will be seen hereinafter that the functions carried out by ramps 17 and 18 (in FIG. 3) are now carried out by ramps 31 and 30. Third ramp 32 is substantially circular and is located in the extension of second ramp 31. A stop 33 is located at the end of this third ramp 32.

The operation of this variant will now be described.

Figure 1:
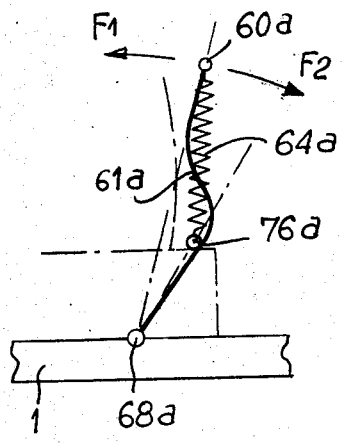
Figure 1A:
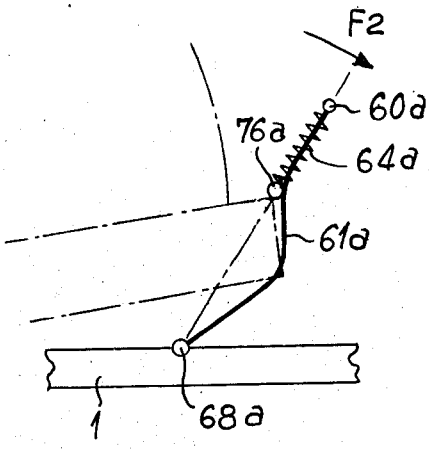
Figure 1B:
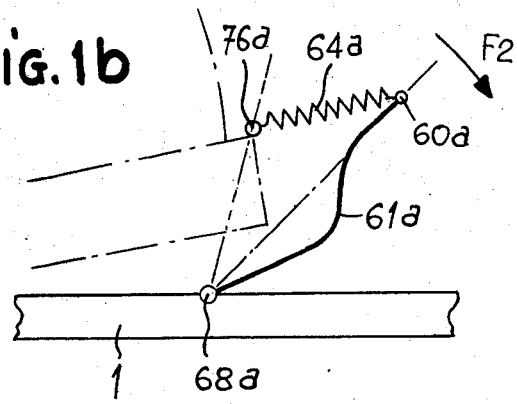
Figure 2:
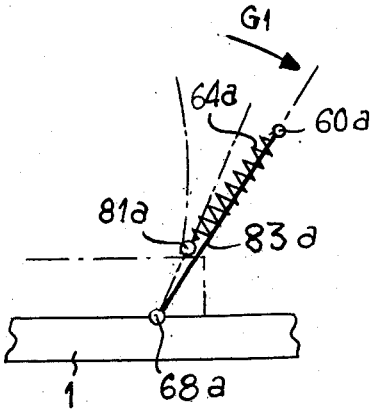
Figure 2A:
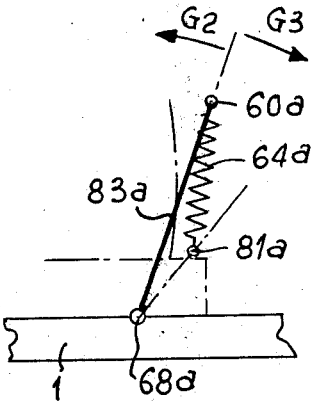

In the event of an accidental release brought about by a vertical load, the boot lifts and carries along with it the jaw, the body, and the links; the body of the heel member tends to pivot forwardly in the direction of arrow $M_1$, as already described in connection with FIGS. 1, 1*a*, 1*b*. The slope of first ramp 30, by means of which cross member 20 is stopped, causes the body to pivot rearwardly. The slope and length of this ramp are such that the path of point of support 11 of the jaw on the boot cuts across the plane defined by the first and second axes 6 and 3 substantially when cross member 20 leaves the inverted U-shaped slot consisting of first and second ramps 30 and 31. As a result of this, the heel member will be able to pivot freely towards the rear; thus for positions of point of support 11 located above the plane defined by first and second axes 6 and 3, the links and the heel member (this was described in connection with FIGS. 2, 2*a*) tend to pivot rearwardly in the direction of arrow $M_2$.

With the boot in position, an inadvertent impact at the end of the heel member in the direction of arrow $M_2$ produces no effect; none of the elements in the binding moves. Second ramp 31 prevents the body from pivoting about axis 3. It is obvious that without this ramp 31, any inadvertent impact would unlock the binding, as already described in connection with FIGS. 1, 1*a*, 1*b*.

Figure 5:
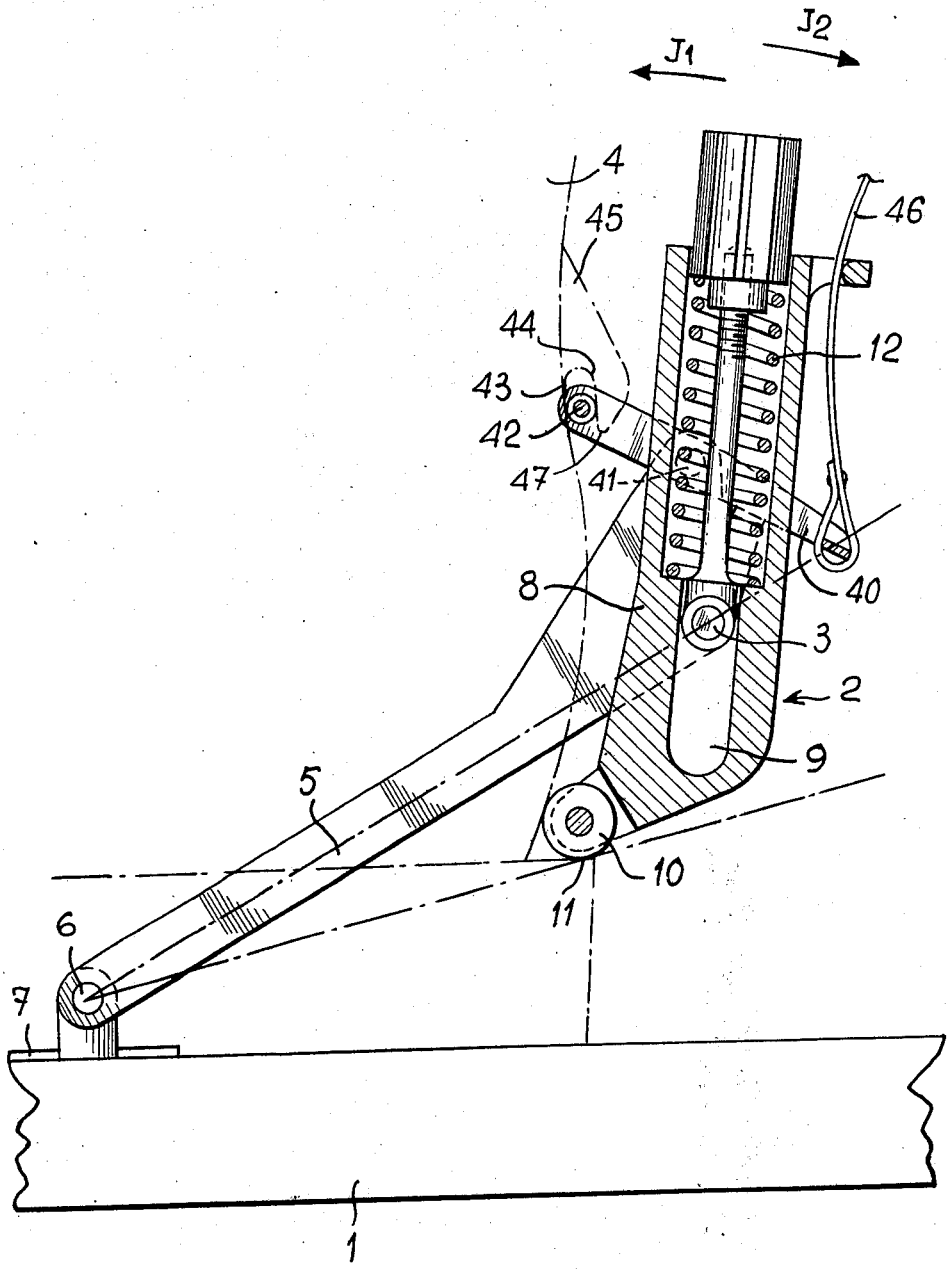
FIG. 5 is a longitudinal section through a third variant of the binding according to the invention.

A description will now be given of FIG. 5, which is a longitudinal section through a third variant of the binding according to the invention, with the boot in position.

Most of the elements described in connection with FIGS. 3 and 4 will be recognized, especially ski 1, boot 4, heel member 2 mounted so as to be mobile in rotation and displacement about a second axis 3 uniting links 5, arms 5 (or links) hinged about a first axis 6 mounted on a pivot 7 attached to the ski, and spring 12.

In this variant, the plane defined by the first and second axes 6 and 3 is also located above point of support 11 of jaw 10 on the end of the boot. The systems of ramps and stops are interposed between boot 4 and links 5, the latter comprising a lever 40 pivoting about an axis 41 integral therewith and parallel with the first and second axes. The ends of the two arms constituting this lever (one arm on each side of the heel member) are connected by a cross member 42. A spring not shown in the figure, but located between the links and lever 40, keeps the latter and cross member 42 in the raised position. With the boot in position, this cross member is held between two ramps 43, 44 located on the boot upper, in the plane of symmetry of the boot. Ramps 43, 44 are substantially parallel and vertical; they are standardized and mounted on the boot by means of a separate part 45; they could be produced directly by moulding during the manufacture of the boot. One of them, the second, 44, is in the form of a thin tooth; this tooth may even have a certain amount of resilient deformability for the purpose of facilitating release of the boot, especially laterally, resulting from a transverse load in the absence of pivoting. The other end of the lever is provided with a thong 46 which the skier may pull when he wishes to remove his skis.

The operation of this binding will now be described.

In the event of an accidental release resulting from an abnormally high vertical load, the boot lifts and tends to cause the heel member and links to pivot forwardly in the direction of arrow $J_1$. First ramp 43, against which links 5 are stopped by lever 40 and cross member 42, prevent this movement of rotation towards the front of the heel member. The boot therefore lifts body 8 against the action of spring 12. During this movement, the second axis 3 slides in slot 9 in the body. The profile of first ramp 43, and the length thereof, are such that the path of point of support 11 of jaw 10 on the sole of the boot crosses the plane defined by the first and second axes 6 and 3 when cross member 42 leaves the inverted U-shaped slot consisting of ramps 43, 44 located opposite each other. As soon as cross member 42 passes release nose 47, the heel member will pivot freely towards the rear in the direction of arrow $J_2$. Thus, as already indicated, for positions of the point of support located above the plane defined by first and second axes 6 and 3, the links and the body tend to pivot rearwardly.

With the boot in position, an inadvertent impact on the end of the heel member, in the direction of arrow $J_2$, produces no effect; none of the elements of the binding moves. Second ramp 44, located on the tooth, prevents the body from pivoting rearwardly about axis 3. Without this second ramp, the heel member would become unlocked at the slightest inadvertent blow.

When he wishes to remove his skis, the skier pulls on thongs 46. It is obvious that upon pulling thong 46, the skier releases cross member 42 from the U-shaped slot formed by ramps 43, 44, causing the links to pivot downwardly, so that point of support 11 will pass above the plane defined by the first and second axes, with no need to compress spring 12 to any great extent. The heel member may then pivot freely towards the rear. When the binding is released, the locking spring does not remain compressed, as in the preceding example.

When he wishes to put his skis on, the skier places his boot in the binding and then pulls on thong 46; this causes the body, and therefore point of support 11, to pivot below the plane defined by axes 6 and 3; when the skier releases thong 46, cross member 42 locks itself automatically between ramps 43 and 44.

Figure 6:
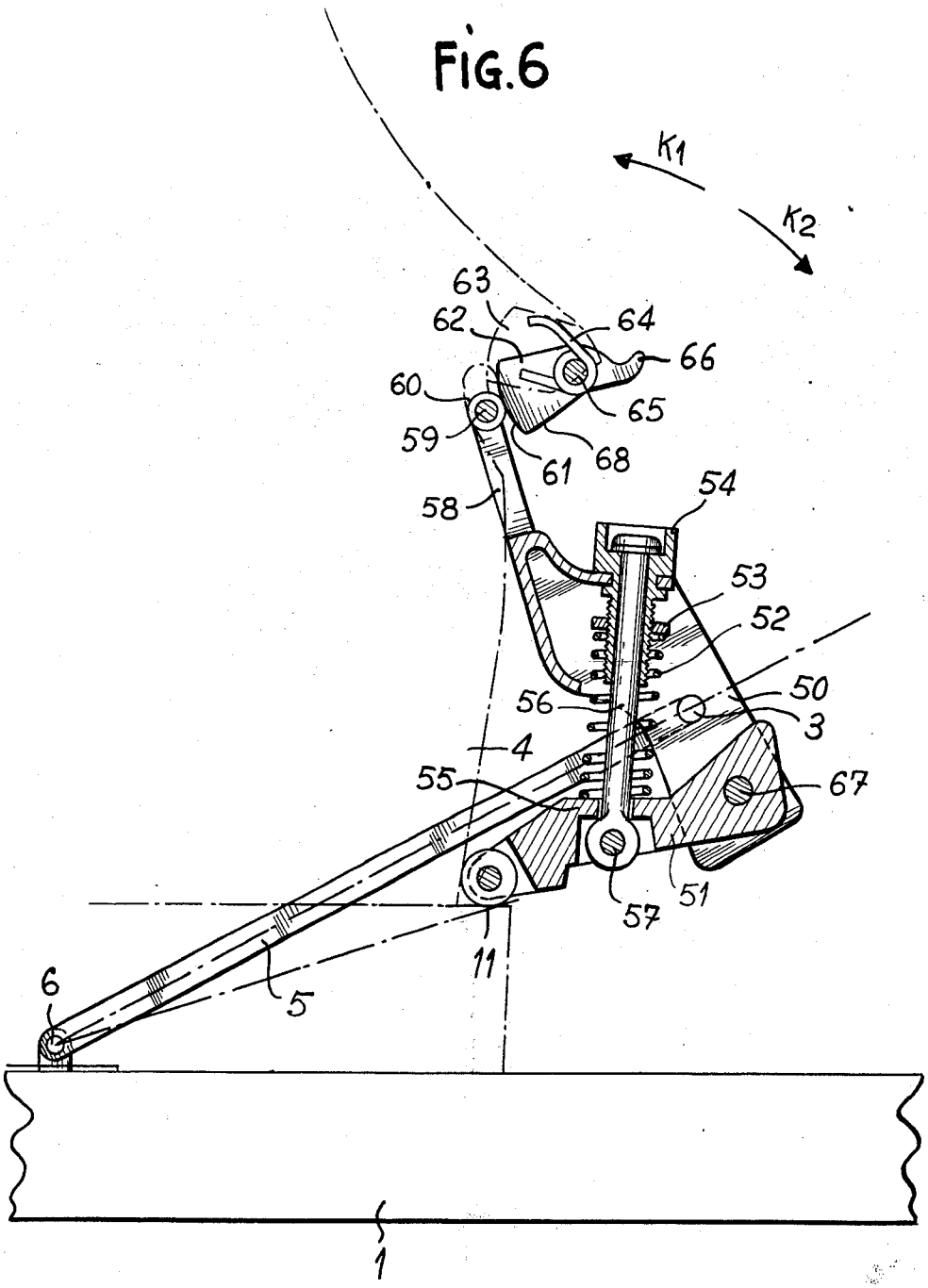
FIG. 6 is a longitudinal section through a fourth variant of the binding according to the invenion.

A description will now be given of FIG. 6, which is a longitudinal section through a fourth variant of the binding according to the invention, with the boot in position.

The following may be recognized: ski 1, boot 4 hinged to the first axis 6, and links 5. In this variant, the retaining element is of a different design and consists of:

a body 15 adapted to rotate about an axis 3 parallel with the plane of the ski, uniting links 5 behind the heel of the boot;

a jaw 51 adapted to rotate about an axis 67 integral with body 50 and parallel with axis 3;

a coil spring 52, one end of which rests against a collar 53 screwed to a threaded socket 54 mounted so that it can rotate in the body, while the other end bears upon upper annular surface 55 of the jaw; a rod 56, hinged to the jaw at 57, passes through spring 52 and slides in threaded socket 54 which is used mainly to adjust the tension of the spring.

In this variant, the plane defined by the first and second axes 6 and 3 is located above point of support 11 of jaw 51 on the sole of the boot. The systems of ramps and stops are interposed between body 50 and boot 4. Body 50 comprises a vertical extension consisting of two arms 58, only one of which is shown, united by a cross member 59. With the boot in position, this cross member 59 is engaged between two ramps 60, 61 located on the boot upper in the rear plane of symmetry of the heel. These two ramps, which face each other, are substantially parallel and vertical and are preferably standardized; they may be obtained directly by moulding, or they may be fitted to the boot subsequently. This applies particularly, in the variant shown in FIG. 6, to second ramp 61 which is mounted upon a pawl 62 adapted to retract into a housing 63 arranged on the rear of the boot upper. This pawl is actuated by a hairpin spring 64 which keeps it in the low operative position, and it pivots about an axis 65 integral with the boot upper. An actuating element 66 allows the skier to retract the pawl by applying a downward pressure (especially with the tip of his ski-pole).

The operation of this binding will now be described.

In the event of an accidential release resulting from an abnormally high vertical load, the boot lifts and tends to cause the links and the retaining element to pivot forwardly in the direction of arrow $K_1$. First ramp 60, against which the body is stopped by cross member 59, prevents this forward rotation. The boot therefore lifts jaw 51, which pivots about axis 67 against the action of spring 52.

The profiles (length and slope) of ramps 60, 61 are such that the path of point of support 11 of the jaw on the end of the boot crosses the plane defined by first and second axes 6 and 3 when cross member 59 leaves the inverted U-shaped slot formed by first and second ramps 60, 61. This will enable the heel member to pivot freely towards the rear. Thus, as already indicated, for positions of point of support 11 located above the plane defined by axes 6 and 3, the links and the body tend to pivot rearwardly. The slope of first ramp 60 also assists in pivoting the retaining element about second axis 3, and in releasing the boot.

With the boot in position, an inadvertent impact on the upper end of the body, in the direction of arrow $K_2$, produces no effect; none of the elements of the binding moves. Second ramp 61, integral with pawl 62, prevents the body from pivoting rearwardly about axis 3. Without this second ramp, there would be a risk of the retaining element becoming unlocked at the slightest inadvertent impact.

When he wishes to remove his skis, the skier applies pressure to operating element 66 of pawl 62 in order to retract second ramp 61. All that it is then required is to push the body towards the rear, in the direction of arrow $K_2$, lifting the heel slightly in order to release the boot from the heel member.

In order to put his skis on again, the skier, having placed his boot in the binding, pivots the retaining element and the links in the direction of arrow $K_1$, causing the jaw to pivot below the plane defined by first and second axes 6 and 3. Cross member 59, carried along by the body, becomes engaged automatically between ramps 60 and 61, temporarily retracting the pawl by which it is stopped momentarily on its rear surface 68.

This invention may be combined with other bindings, especially with stops designed to release under the action of an abnormally high lateral load. In this case, the heel piece according to the invention is mounted on a base plate which is itself adapted to pivot about a vertical axis mounted on the ski under the skier's heel. As a result of this, the links do not interfere with the lateral release of the boot, under the action of a lateral load, except to a perfectly controllable degree. Adjusting the distance between the links makes it possible to adjust the extent to which the links contribute to the lateral stability of the boot, but without preventing the release of the front stop, since the boot and the heel member may pivot with the base plate.

The binding also relates to standard ski boots comprising ramp systems as described above in connection with FIGS. 5 and 6.

What is claimed is:

1. A safety binding for a ski boot designed to retain one of the ends of the boot and comprising:

a. two lateral arms extending along each side of the boot and hinged at one end thereof, in relation to the ski, about a first pivoting means having a first pivoting axis parallel with the plane of the ski;

b. a retaining element, pivotally mounted in relation to a second pivoting means uniting the other ends of said lateral arms; said second pivoting means having a second pivoting axis parallel with the plane of the ski; said retaining element comprising jaw means for holding the boot and being actuated by a resilient element;

c. first locking means for temporarily interacting the three following elements: the boot, the lateral arms and the retaining elements, in relative motion against the action of said resilient element; said first locking means comprising a ramp and a stop temporarily interposed between two of said three elements in relative motion; and d. second locking means for preventing temporarily said retaining element from pivoting, said second locking means comprising a ramp and a stop temporarily interposed between two of the following three elements in relative motion: the boot, the lateral arms and the releasing element.

2. A safety binding according to claim 1, characterized in that:

the ramp of the first locking means is integral with the releasing element, the stop of the first locking means is integral with the lateral arms.

3. A safety binding according to claim 2, characterized in that:

the ramp of the second locking means is integral with the releasing element, the stop of the second locking means is integral with the lateral arms.

4. A safety binding according to claim 3 and comprising a retaining element rotatably and slidably mounted in relation to said second pivoting means, wherein:

the ramp of the second locking means is located opposite the ramp of the first locking means, the stops of the first and second locking means are constituted by a cross member integral with the lateral arms, whereby in the event of a release, said cross member slides between the two ramps.

5. A saftey binding according to claim 4 wherein the retaining element moves above the second pivoting means between a first operative position and a second inoperative position the retaining element comprising a third ramp against which the cross member is stopped when the retaining element is in the second inoperative position.

6. A safety binding according to claim 5, characterized in that the third ramp, integral with the releasing element, is substantially circular and has an axis aligned with said second pivoting means whenever in said inoperative position, said releasing element is in substantially neutral equilibrium.

7. A safety binding according to claim 6, characterized in that the binding comprises, furthermore, a voluntary ski-removal lever pivoting about said second pivoting means uniting the lateral arms, said lever comprising a pin co-operating with a ramp integral with the retaining element, so that when the skier actuates said lever, he causes the retaining element to slide in relation to said second pivoting means against the action of the resilient element.

8. A safety binding according to claim 1, characterized in that:

the ramp of the first locking means is integral with the rear end of the boot, the stop of the first locking means is located at the end of a lever pivoting about a pivot located on the lateral arms and parallel with the plane of the ski, said lever is actuated into a raised position by a resilient element.

9. A safety binding according to claim 8, characterized in that:

the ramp of the second locking means is integral with the end of the boot, the stop of the second locking means is located at the end of the pivoting lever.

10. A safety binding according to claim 1, comprising a retaining element mobile rotatably and slidably mounted in relation to said second pivoting means, wherein:

the ramps of the first and second locking means are located facing each other at the rear end of the boot upper, the stops of the first and second locking means consist of a cross member parallel with the plane of the ski, located at the end of said lever, whereby, in the event of a release, said cross member slides between the two ramps.

11. A safety binding according to claim 10, characterized in that the other end of said lever comprises an actuating means to voluntarily release the cross member from the two ramps facing each other.

12. A safety binding according to claim 1, characterized in that the retaining element comprises:

a body adapted to rotate about said second pivoting means, a jaw hinged about a pivot mounted on said body, a resilient element, one end of which bears against said body and the other against the jaw.

13. A safety binding according to claim 12, characterized in that:

the ramp of the first locking means is integral with the boot upper, the stop of the first locking means is located on the body.

14. A safety binding according to claim 13, characterized in that:

the ramp of the second locking means is hinged to the end of the boot, the stop of the first locking means is located on the body.

15. A safety binding according to claim 14, characterized in that:

the ramps of the first and second locking means are located facing each other on the boot, the stops of the first and second locking means consist of a cross member parallel with the plane of the ski.

16. A safety binding according to claim 15, characterized in that the ramp of the second locking means is mounted on a pawl adapted to be retracted by an actuating element operated by the skier.

* * * * *